US007011385B2

(12) United States Patent
Kitabatake et al.

(10) Patent No.: US 7,011,385 B2
(45) Date of Patent: Mar. 14, 2006

(54) INK TANK AND INK JET PRINTER

(75) Inventors: Kenji Kitabatake, Kanagawa (JP); Wataru Takahashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 147 days.

(21) Appl. No.: 10/729,304

(22) Filed: Dec. 4, 2003

(65) Prior Publication Data

US 2004/0114003 A1 Jun. 17, 2004

(30) Foreign Application Priority Data

Dec. 9, 2002 (JP) ..... 2002-356242

(51) Int. Cl.
*B41J 29/393* (2006.01)
*B41J 2/175* (2006.01)

(52) U.S. Cl. ..... 347/19; 347/86

(58) Field of Classification Search ..... 347/7, 347/19, 85, 86, 87

See application file for complete search history.

(56) References Cited

U.S. PATENT DOCUMENTS 5,250,957 A * 10/1993 Onozato ..... 347/7
5,997,121 A * 12/1999 Altfather et al. ..... 347/7
6,102,517 A * 8/2000 Kobayashi et al. ..... 347/23

FOREIGN PATENT DOCUMENTS

DE GM 80 23 471 * 11/1980
JP 6-286160 10/1994
JP 9-174877 7/1997

* cited by examiner

*Primary Examiner*—Anh T. N. Vo
(74) *Attorney, Agent, or Firm*—Morgan & Finnegan, L.L.P.

(57) ABSTRACT

An ink tank comprises an ink containing portion for containing ink, an ink lead-out portion for leading out ink in said ink containing portion to the outside, and an electrode inlet portion for inletting an electrode into said ink containing portion, said electrode inlet portion being different from said ink lead-out portion, wherein said ink lead-out portion and said electrode inlet portion are connected through a conductive member.

6 Claims, 9 Drawing Sheets

INK TANK AND INK JET PRINTER

BACKGROUND OF THE INVENTION

1. Field of the Invention

The present invention relates to an ink tank and an ink jet printer. More particularly, the invention relates to an ink jet printer capable of detecting the presence and absence of the ink tank to be installed stationarily in a printer, and the presence and absence of liquid as well. The invention also relates to an ink tank to be used for such printer.

2. Related Background Art

Conventionally, as the ink-availability detection mechanism for an ink tank that contains ink, there has been known the one that measures the electric conductivity between electrodes with the provision of electrodes in an ink tank as disclosed in the specification of Japanese Patent Application Laid-Open No. 06-286160, for example or means for detecting the presence and absence of ink optically.

However, the unavailability of ink is detected, and when the user replaces ink tanks, the ink tank is removed from the printer for a long time so as to cause the ink lead-out port of the printer to be released to the air outside. Then, there occurs a fear that ink component is solidified in the ink lead-out port, and the communication of ink is impeded when connecting an ink tank again. Also, the quality of ink in the lead-out port and in the ink supply path is caused to change, and there is a fear that when an ink tank is connected again, such ink flows into the head so as to destroy the head eventually. To prevent such event, it is arranged for the printer to detect the presence and absence of ink tank, and a system is provided for the printer to give warning to the user, if the status where the ink tank has been removed should continue for a long time.

Means for detecting the presence and absence of ink tank have been proposed conventionally in some forms. For example, as disclosed in the specification of Japanese Patent Application Laid-Open No. 09-174877, it is possible to detect the presence and absence of ink, and the presence and absence of ink tank as well by use of one optical sensor provided for a printer where the ink tank is arranged on a carriage and the ink tank moves along the movement of the carriage. Also, in this case, it is possible to detect the presence and absence of ink and those of ink tank even if the arrangement is made so that ink tanks are individually provided to deal with plural colors.

However, ink tank is stationarily installed in a printer, it is required to arrange optical sensors in a number of two times the numbers of ink tanks or to make the sensor movable if it is intended to detect the presence and absence of ink in the ink tank, and also, to detect the presence and absence of the ink tank. This inevitably leads to the problem that such system is extremely expensive.

SUMMARY OF THE INVENTION

The present invention is designed with a view to solving the problems discussed above. It is an object of the invention to provide an ink tank, as well as an ink jet printer, capable of detecting with a simple mechanism three conditions, (1) ink present and ink tank present, (2) ink absent and ink tank present, and (3) ink absent and tank absent, that is, a combined detection of the presence and absence of ink in the ink tank, and the presence and absence of the tank for a printer even when the ink tank is stationarily installed in the printer.

In order to achieve the object described above, the ink tank of the present invention comprises an ink containing portion for containing ink, an ink lead-out portion for leading out ink in said ink containing portion to the outside, and an electrode inlet portion for inletting an electrode into said ink containing portion, said electrode inlet portion being different from said ink lead-out portion, wherein said ink lead-out portion and said electrode inlet portion are connected through a conductive member.

Also, the ink jet printer of the present invention, which is capable of mounting the ink tank referred to the preceding paragraph, comprises a conductive ink lead-out member to be inserted into said ink lead-out portion, an electrode to be inserted into said electrode inlet portion, and a circuit portion for applying voltage between said ink lead-out member and said electrode and for measuring an electric current in a route, wherein the electric current measured by said circuit portion changes in accordance with the presence and absence of ink in said ink tank, and the attachment and detachment of ink tank to and from said ink jet printer.

In accordance with the invention hereof, there are provided the ink lead-out portion and the electrode inlet portion, which are connected through a conductive member. Therefore, even if no ink exists, it is possible to easily discriminate on the printer side the condition where the ink tank is installed from the condition where the ink tank is removed. Further, since the electrical resistance is different in the status where ink is contained, it is possible to easily discriminate the condition where ink is contained from the one where ink does not exist.

DETAILED DESCRIPTION OF THE PREFERRED EMBODIMENTS

Hereinafter, with reference to the accompanying drawings, the description will be made of the embodiments in accordance with the present invention. Here, the description given below exemplifies an ink tank stationarily installed in a printer. However, the present invention is also applicable to the case where an ink tank is mounted on a carriage, not stationarily installed in a printer.

(First Embodiment)

Figure 1:
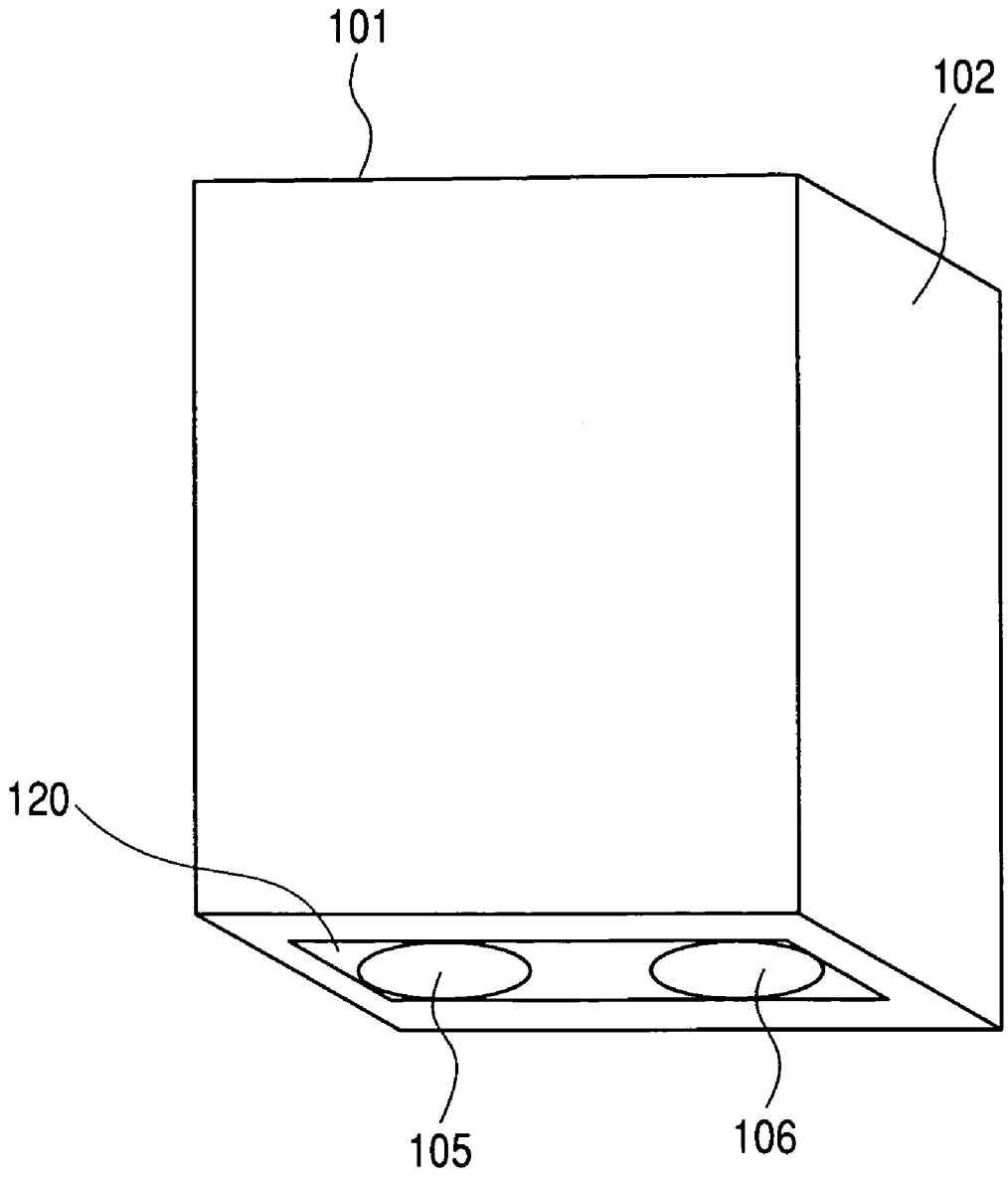
FIG. 1 is a perspective view that illustrates an ink tank embodying the present invention.

FIG. 1 is a perspective view that shows one embodiment of an ink tank in accordance with the present invention. The ink tank 101 is provided with an ink tank vessel 102 for containing ink (not shown); an ink lead-out port 105, which is arranged on the bottom face of the ink tank vessel 102 for the ink jet printer that installs this ink tank, and serves as the ink lead-out portion where an ink lead-out needle arranged therefor can be inserted; and an electrode inlet port 106, which serves likewise as the electrode inlet portion where the electrode needle arranged for the ink jet printer can be inserted. At the outset, both the ink lead-out port 105 and the electrode inlet port 106 are airtightly closed or sealed by means of a film 120, which adheres to the ink tank vessel 102. In this manner, it is made possible to prevent ink from leaking to the outside of the ink tank, should ink inside leaks from the ink lead-out port and the electrode inlet port at the time of transportation or the like.

Figure 2:
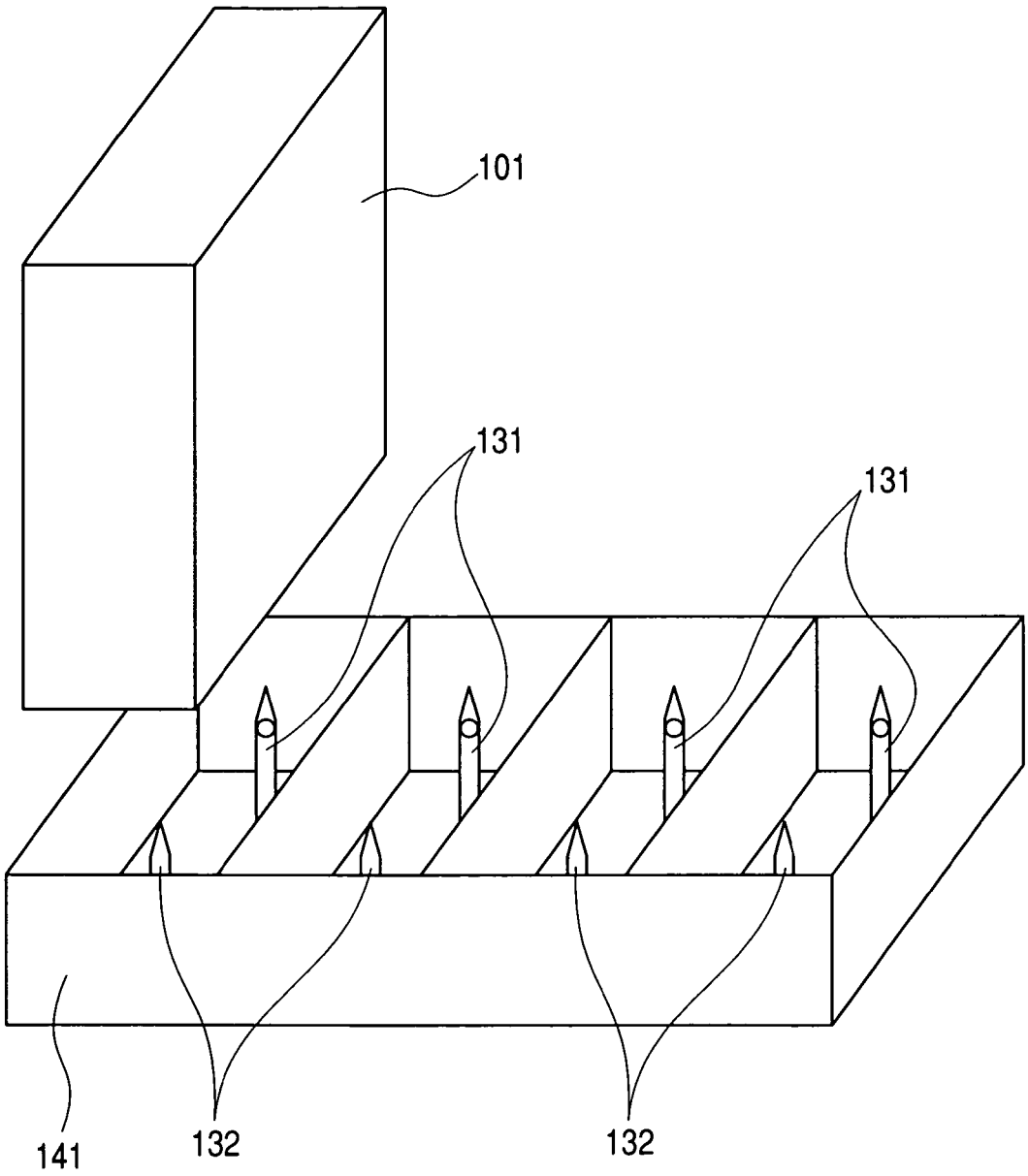
FIG. 2 is a perspective view that shows the ink tank and ink tank holding portion embodying the present invention.

FIG. 2 is a perspective view that shows the relations between the ink tank 101 and the ink tank holder 141, which serves for the ink jet printer as the ink tank receiving portion. In accordance with the present embodiment, the ink jet printer is a color ink jet printer that uses ink of four colors, black, cyan, magenta, and yellow, which installs ink tanks each having independent color, respectively. In order to simplify the view, FIG. 2 shows only an ink tank using one color of yellow ink. The ink tank 101 is inserted into the ink tank holder 141 from the above. Then, the ink lead-out needle 131 and the electrode needle 132 arranged in the ink tank holder 141 are inserted into the ink lead-out port and the electrode inlet port of the ink tank 101. In this process, it is arranged for the ink lead-out needle 131 and electrode needle 132 to break through the film 120 of the ink tank 101.

Figure 3:
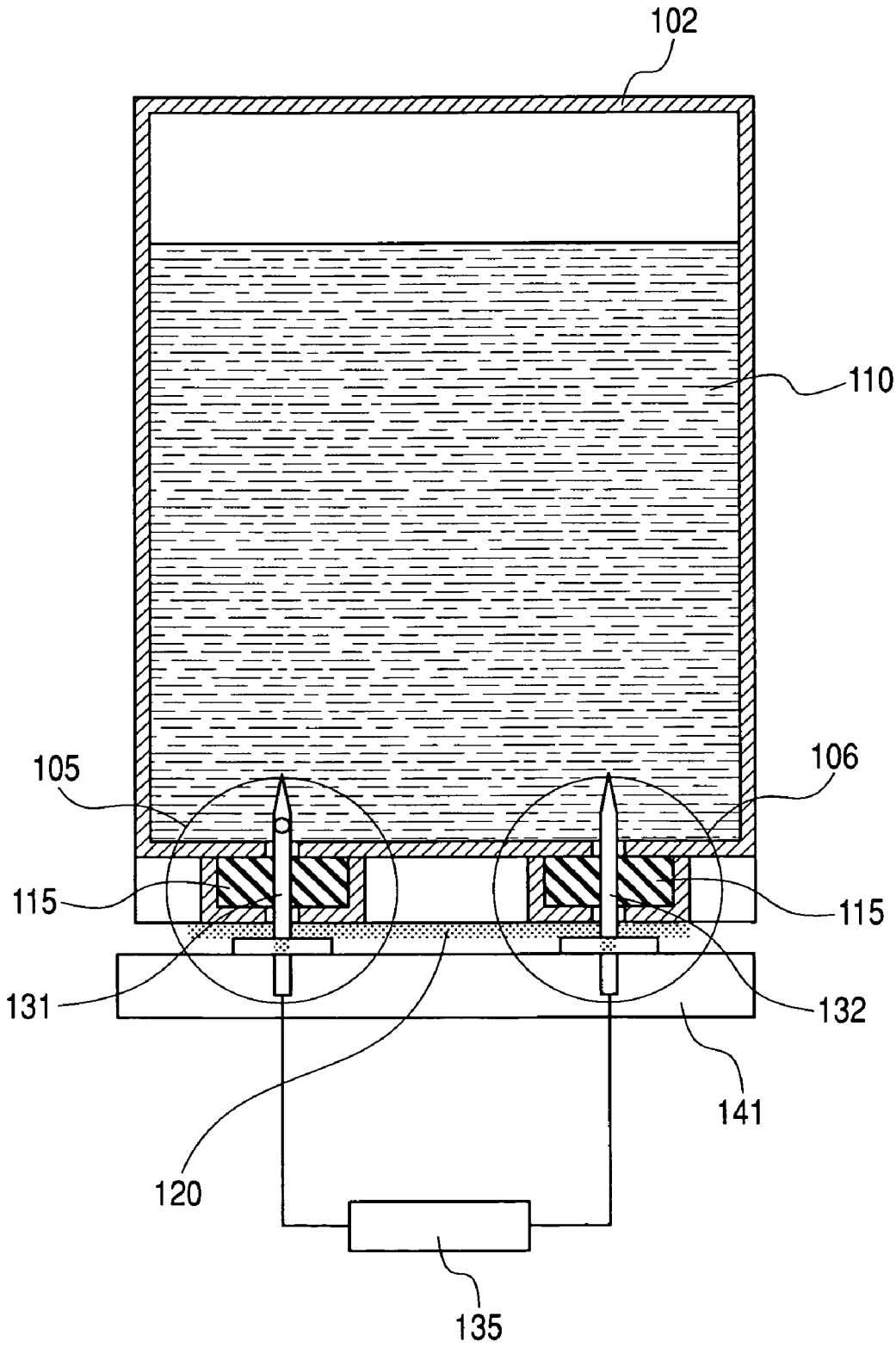
FIG. 3 is a cross-sectional view that shows the ink tank and ink tank holding portion embodying the present invention.

FIG. 3 is a cross-sectional view that shows the state where the ink tank 101 is inserted into the ink holder 141. The ink lead-out port 105 and electrode inlet port 106 of the ink tank 101 are both sealed with joint rubbers 115, and as shown in FIG. 3, in the state of being installed on the ink tank holder 141, these are penetrated by the conductive ink lead-out needle 131 and electrode needle 132, respectively. Also, on the surface of the film 120, conductive substance is coated so as to make the ink lead-out needle 131 and electrode needle 132 conductive through the conductive substance when installed on the ink tank holder 141. For the present embodiment, the conductive substance is graphite coating, but any substance is usable if only it has conductivity.

In accordance with the present embodiment, the gap between the ink lead-out needle 131 and electrode needle 132 is 18 mm, and the impedance Z2 of the conductive substance coated on the film 120 is approximately 200 kΩ across the needles.

Also, the ink tank 101 is filled with ink 110 at the initial condition, and when the ink tank 101 is installed on the ink tank holder 141, the ink lead-out needle 131 and electrode needle 132 are in contact with ink 110. At this juncture, the impedance Z1 of ink 110 across the needles is approximately 400 kΩ.

Figure 4:
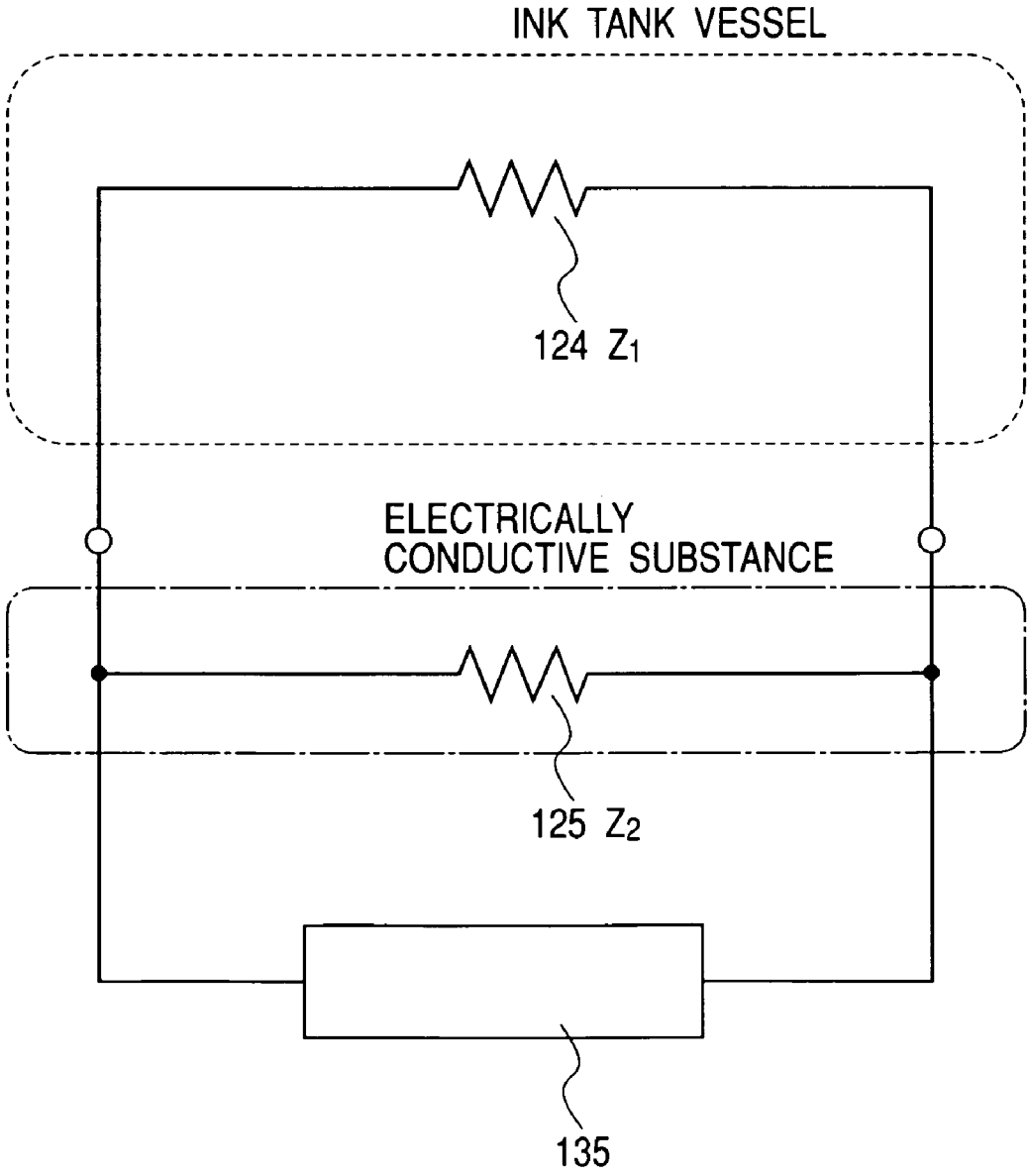
FIG. 4 is a schematic view that shows a circuit structure embodying the present invention.

FIG. 4 is a schematic view that shows the circuit system embodying the present invention, and the impedance of ink is given as Z1 and the impedance of the conductive substance as Z2. From the circuit portion 135, a voltage of DC 5V is applied. Further, a system is incorporated to measure the value of passing current in the course.

Figure 5:
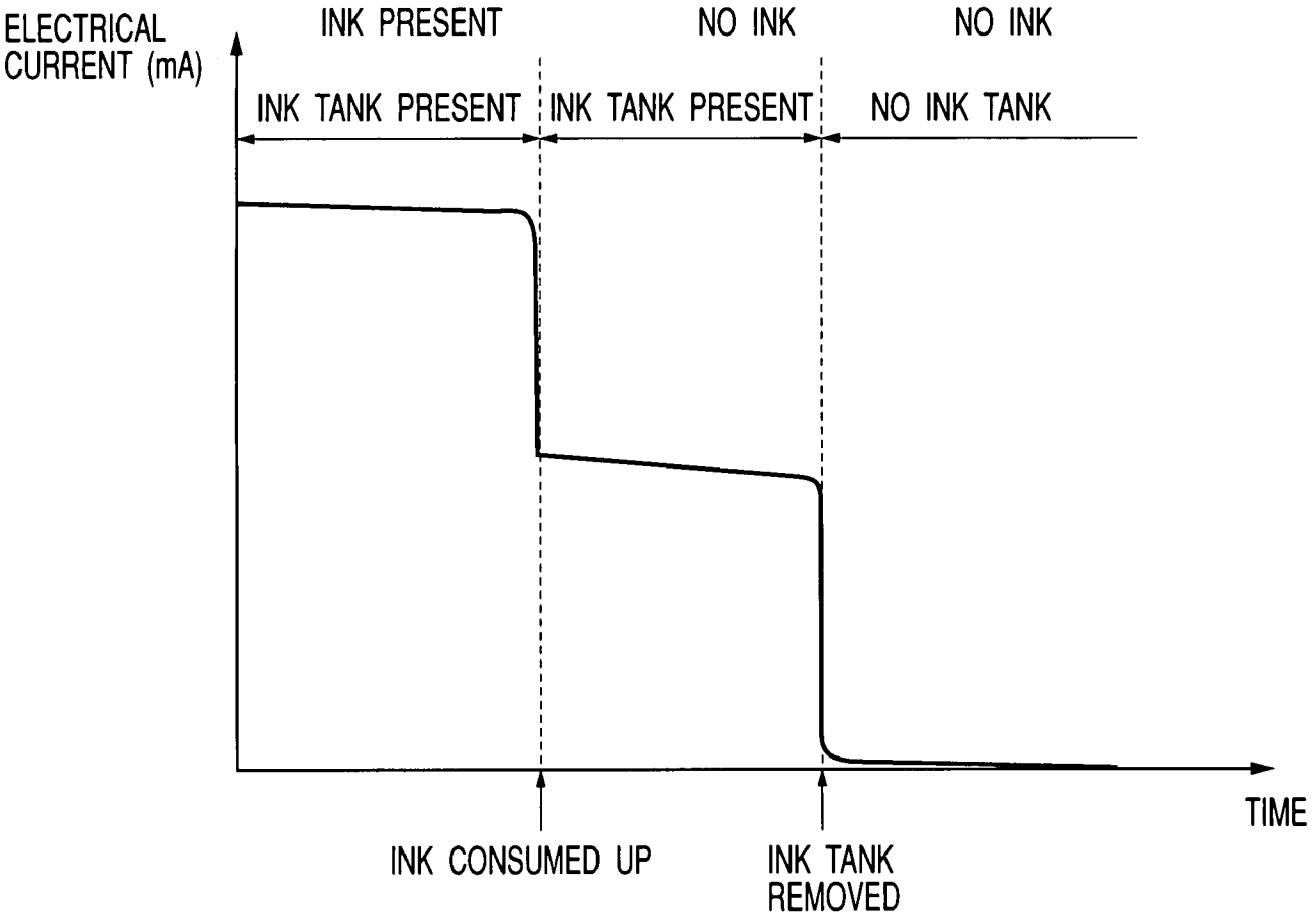
FIG. 5 is a graph that shows the correlations between the ink tank status and the electric current in the circuit in accordance with the present embodiment of the present invention.

FIG. 5 is a graph that shows the correlations between the condition of the ink tank of the present embodiment, and the current measured by the circuit portion.

At first, when the ink tank 101 filled with ink 110 is installed on the ink tank holder 141, the impedance Z1 of ink 110 is equal to approximately 400 kΩ, and then, the impedance Z2 of the conductive substance is equal to approximately 200 kΩ. Therefore, the composite impedance Zinit of the circuit system, which is expressed by 1/Zinit=1/Z1+1/Z2, is approximately 100 kΩ.

Next, ink 110 is used for printing and the like, and when ink 110 remains no longer in the ink tank 101, the Z1 becomes infinite. The impedance Zend of the circuit system at the time of ink being unavailable is the Zend=Z2, that is, approximately 200 kΩ.

Lastly, in the state where the ink tank 101 is removed by the user, neither ink nor the conductive substance exists in the circuit system. The impedance Zemp at that time is made infinite.

Now, FIG. 5 is the graph in which these conditions are expressed. The condition of ink tank is indicated on the axis of ordinate, and the current measured by the circuit portion is indicated on the axis of abscissa. In accordance with the present embodiment, the relations of impedances make it possible to detect the difference of approximately two times by the current value as to the (ink present and ink tank present) and the (ink absent and ink tank present). Further, in the cases of the (ink absent and ink tank absent), the current value is almost 0. Thus, it is made easier to distinguish these three different conditions.

For the present embodiment, the kind of ink is defined as yellow. However, if ink is water soluble, the characteristics of impedances are distributed within a range of approximately 50 kΩ to 2,000 kΩ. Therefore, it is also possible to detect the presence and absence of ink per color by devising the circuit structure and the read-out sequence correspondingly.

(Second Embodiment)

Figure 6:
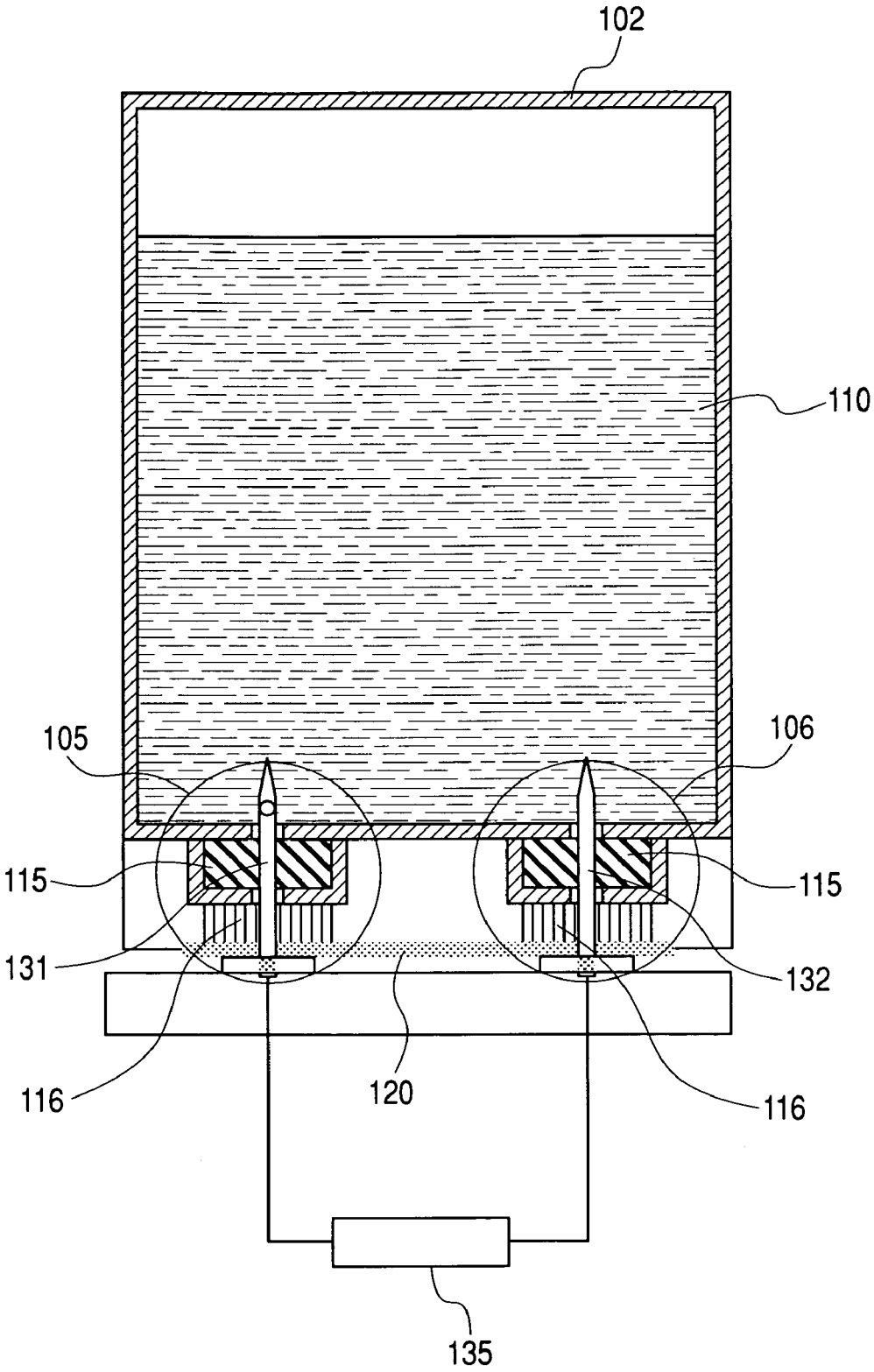
FIG. 6 is a cross-sectional view that shows the ink tank and ink holder embodying the present invention.

FIG. 6 is a cross-sectional view that shows the state where the ink tank 101 embodying the present invention is inserted into an ink tank holder 141. There is a fear for the mode of ink tank shown in the first embodiment that if the insertion of the ink tank 101 is repeated for plural times with respect to the ink tank holder 141, the ink lead-out needle and the electrode needle are short-circuited, leading to an erroneous detection, because ink adhering to the needles, ink lead-out port 105, and electrode inlet port 106 is allowed to drop off. Now, therefore, as shown in the present embodiment, both the ink lead-out port 105 and electrode inlet port 106 of the ink tank 101 are sealed with joint rubbers 115. Then, absorbents 116 are arranged below them. The absorbents 116 are held by the film 120 and the ink tank vessel 102. With the structure thus arranged, should any situation occur to allow the dropping off of ink, the absorbents absorb such ink quickly so as to prevent it beforehand.

Further, if the absorbents 116 are compressed and kept by the film 120, the absorbents 116 exert force to push and expand the film 120 outward. As a result, the conductive substance coated on the film, the ink lead-out needle 131, and the electrode needle 132 are in contact more closely, thus making it possible to secure the conductive condition between the conductive substance, and the ink lead-out needle 131 and electrode needle 132.

(Third Embodiment)

Figure 7:
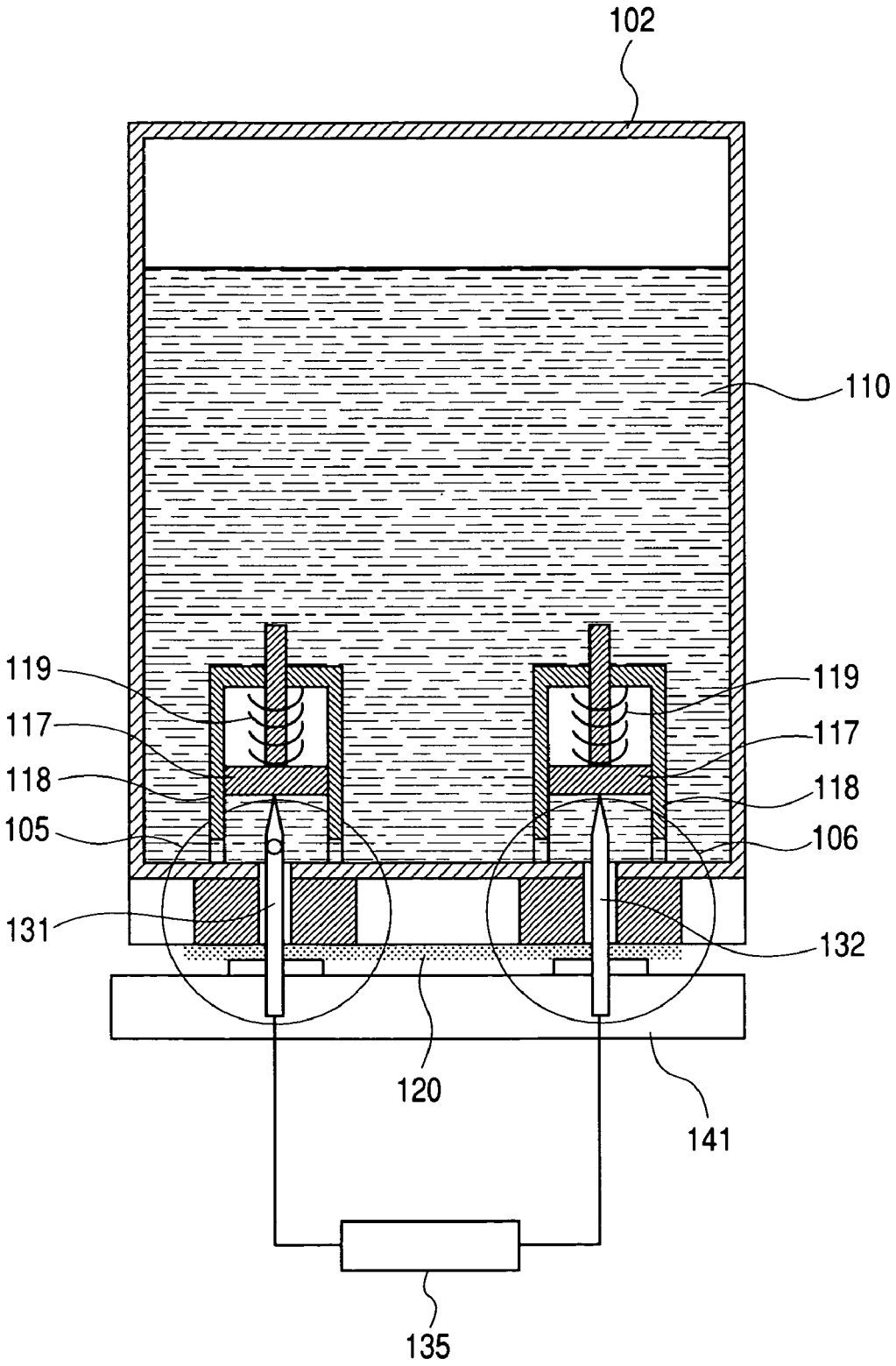
FIG. 7 is a cross-sectional view that shows the ink tank and ink holder embodying the present invention.

There is a fear that the joint rubbers described in conjunction with the first and second embodiments are deteriorated when the ink tank 101 is attached to and detached from the ink tank holder 141 for plural times or the installed condition continues for a long time, and that the sealing capability thereof is lowered. Therefore, in order to secure the durability thereof, it is possible to replace them with the mechanical valve structure as shown in FIG. 7. Each valve is formed by a valve body 117, a valve frame 118, and a spring 119. Usually, the valve body is compressed to the inner wall of the ink tank vessel 102 by the repulsion of the spring. Thus, the opening portions of the ink lead-out port 105 and the electrode inlet port 106 are sealed. When the ink tank 101 is installed on the ink tank holder 141, the ink lead-out needle 131 and the electrode needle 132 push the valve body upward to enable ink and needles to be in contact.

Here, for this structure, too, it is desirable to arrange the absorbents described in conjunction with the second embodiment appropriately, because there occurs ink dropping off from the valves.

(Fourth Embodiment)

For the structures described in the first to third embodiments, it may be possible to replace the conductive substance with resistive element. There are some cases where variations occur depending on the coating condition when it is intended to control impedance by use of the conductive substance. Therefore, the resistive element, which is available on the market, is incorporated in the circuitry. Then, it is made possible to set the impedance Z2 within a range of variation of resistive value regulated for such resistive element.

Figure 8:
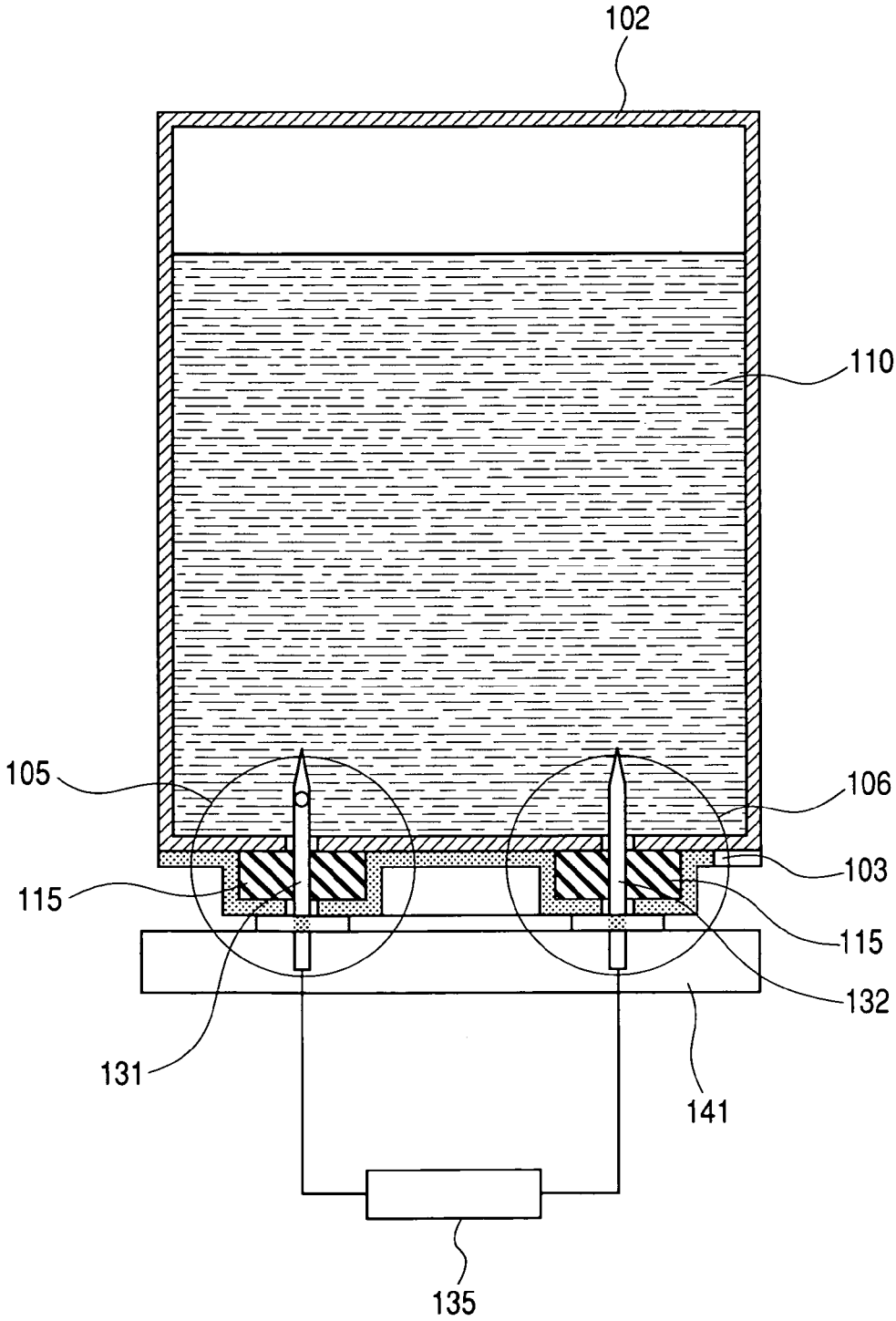
FIG. 8 is a cross-sectional view that shows the ink tank and ink holder embodying the present invention.
Figure 9:
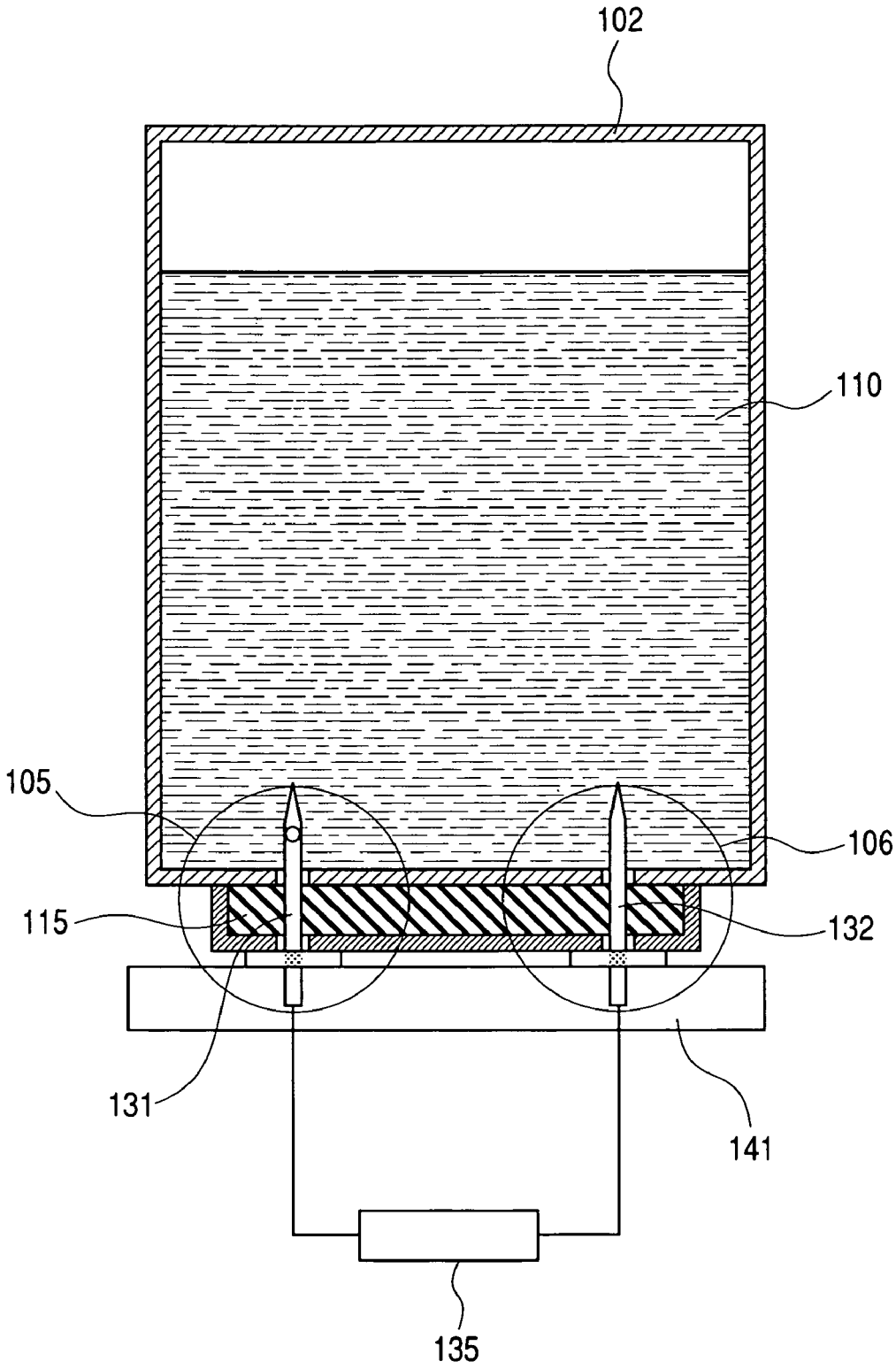
FIG. 9 is a cross-sectional view that shows the ink tank and ink holder embodying the present invention.

Also, for the above embodiments, it has been described that the conductive substance is coated on a film. However, the conductive substance is not necessarily the film if only insulated from ink in the ink containing portion. FIG. 8 and FIG. 9 illustrate the other embodiments of the present invention in which substances other than a film are selected as conductive ones. In FIG. 8, the ink tank cover 103, which is provided independently from the ink tank vessel 102 formed by non-conductive substance, is made by conductive substance. In FIG. 9, the joint rubbers 115, which are provided independently from the ink tank vessel 102 formed by non-conductive substance, are made by conductive substance. In either case, it is made possible to electrically connect the ink lead-out needle and the electrode needle when the ink tank is installed on a printer as in the case of the conductive film used for the each of the embodiments previously described. Also, the ink tank cover and joint rubbers are insulated by the ink tank vessel from ink in the ink containing portion. Consequently, it is still possible to detect the presence and absence of ink.

As described above, the present invention is the combined detections of three conditions as to the presence and absence of ink in the ink tank, and the presence and absence of the tank for the printer, that is, (1) ink present and ink tank present, (2) ink absent and ink tank present, and (3) ink absent and tank absent, by use of a simple mechanism.

What is claimed is:

1. An ink tank comprising:

an ink containing portion for containing ink;

an ink lead-out portion for leading out ink in said ink containing portion to the outside; and an electrode inlet portion for inletting an electrode into said ink containing portion, said electrode inlet portion being different from said ink lead-out portion, wherein said ink lead-out portion and said electrode inlet portion are continuously connected through a conductive member.

2. An ink tank according to claim 1, wherein said conductive member is a film having conductive substance coated therefor.

3. An ink tank according to claim 2, wherein said ink lead-out portion and said electrode inlet portion are substantially sealed by said film.

4. An ink tank according to claim 2, wherein for said ink lead-out portion and said electrode inlet portion, an ink absorbing member are arranged to be in contact with said film but not directly in contact with ink in said ink containing portion.

5. An ink jet printer capable of mounting the ink tank according to claim 1 comprising:

a conductive ink lead-out member to be inserted into said ink lead-out portion;

an electrode to be inserted into said electrode inlet portion; and a circuit portion for applying voltage between said ink lead-out member and said electrode and for measuring an electric current in a route, wherein the electric current measured by said circuit portion changes in accordance with the presence and absence of ink in said ink tank, and the attachment and detachment of ink tank to and from said ink jet printer.

6. An ink jet printer according to claim 5, wherein said ink lead-out member is a hollow needle-type metallic member.

* * * * *